US012778290B2

(12) United States Patent
Chen et al.

(10) Patent No.: US 12,778,290 B2
(45) Date of Patent: Nov. 3, 2026

(54) SUPPORTING ASSEMBLY AND METHOD OF MOUNTING THE AFOREMENTIONED SUPPORTING ASSEMBLY ON A RACK

(71) Applicants: KING SLIDE WORKS CO., LTD., Kaohsiung City (TW); KING SLIDE TECHNOLOGY CO., LTD., Kaohsiung City (TW)

(72) Inventors: Ken-Ching Chen, Kaohsiung City (TW); Shun-Ho Yang, Kaohsiung City (TW); Yao-Tsung Chen, Kaohsiung City (TW); Chun-Chiang Wang, Kaohsiung City (TW)

(73) Assignees: KING SLIDE WORKS CO., LTD., Kaohsiung City (TW); KING SLIDE TECHNOLOGY CO., LTD., Kaohsiung City (TW)

( * ) Notice: Subject to any disclaimer, the term of this patent is extended or adjusted under 35 U.S.C. 154(b) by 20 days.

(21) Appl. No.: 19/021,209

(22) Filed: Jan. 15, 2025

(65) Prior Publication Data

US 2026/0000196 A1 Jan. 1, 2026

(30) Foreign Application Priority Data

Jun. 27, 2024 (TW) ..... 113124289

(51) Int. Cl.
*A47B 88/43* (2017.01)

(52) U.S. Cl.
CPC ..... *A47B 88/43* (2017.01); *A47B 2220/0036* (2013.01)

(58) Field of Classification Search
CPC ..... A47B 88/43; A47B 2220/0036; H05K 7/1489
See application file for complete search history.

(56) References Cited

U.S. PATENT DOCUMENTS

| | | | | |
|---|---|---|---|---|
| 6,230,903 | B1 | 5/2001 | Abbott | |
| 8,215,602 | B2 * | 7/2012 | Walter | B60N 2/0818 296/65.13 |
| 11,009,069 | B1 * | 5/2021 | Chen | A47B 88/49 |
| 11,337,330 | B2 * | 5/2022 | Yang | H05K 7/1488 |

(Continued)

FOREIGN PATENT DOCUMENTS

| | | |
|---|---|---|
| CN | 112105209 A | 12/2020 |
| CN | 112105209 B | 2/2022 |

(Continued)

*Primary Examiner* — Ko H Chan
(74) *Attorney, Agent, or Firm* — Winston Hsu

(57) ABSTRACT

A supporting assembly is provided and includes a first bracket, a second bracket, a locking member, a working feature. The first bracket and the second bracket are displaceable relative to each other along a longitudinal direction. The locking member is movable between a locking state and an unlocking state relative to the first bracket. The working feature is arranged on the second bracket. When the first bracket is located at a predetermined position relative to the second bracket, the locking member in the locking state is configured to engage with the working feature to maintain the first bracket at the predetermined position relative to the second bracket. Besides, a method of mounting the aforementioned supporting assembly on a rack is also provided.

18 Claims, 13 Drawing Sheets

(56) References Cited

U.S. PATENT DOCUMENTS

| | | | | |
|---|---|---|---|---|
| 11,547,012 | B2 * | 1/2023 | Tower | H05K 7/1489 |
| 2020/0344907 | A1 * | 10/2020 | Tower | H05K 7/1489 |
| 2023/0107056 | A1 * | 4/2023 | Chen | F16M 13/02<br>248/298.1 |
| 2024/0114643 | A1 * | 4/2024 | Yu | A47B 88/57 |

FOREIGN PATENT DOCUMENTS

| | | | |
|---|---|---|---|
| EP | 3 751 971 | A1 | 12/2020 |
| EP | 3 787 384 | B1 | 6/2022 |
| JP | 2020-199242 | A | 12/2020 |
| JP | 2021-30057 | A | 3/2021 |

* cited by examiner

SUPPORTING ASSEMBLY AND METHOD OF MOUNTING THE AFOREMENTIONED SUPPORTING ASSEMBLY ON A RACK

BACKGROUND OF THE INVENTION

1. Field of the Invention

The present invention relates to a supporting assembly, and more specifically, to a supporting assembly capable of preventing a relative displacement of two brackets thereof.

2. Description of the Prior Art

In U.S. Pat. No. 6,230,903 B1, it discloses a slide rail assembly. The slide rail assembly includes a slide rail mechanism, a first bracket, a second bracket, a biasing member and a lock mechanism. Both the first bracket and the second bracket are displaceable relative to an outer rail of the slide rail mechanism longitudinally. Each of the first bracket and the second bracket includes a mounting pin configured to be mounted on a rack. The biasing member is configured to provide force to the second bracket for driving the second bracket to move away from the first bracket. The lock mechanism is configured to lock the second bracket for preventing a displacement of the second bracket relative to the outer rail and/or the first bracket.

In the aforementioned patent, after the second bracket is displaced to a mounting position relative to the first bracket, the lock mechanism must be operated (e.g., by manually rotating a knob of the lock mechanism) to lock the second bracket, thereby preventing a relative displacement of the first bracket and the second racket. However, if the restricted condition makes manual operation impossible, the second bracket will fail to be locked.

In order to meet various requirements, it becomes an important topic to offer an alternative product.

SUMMARY OF THE INVENTION

It is an objective of the present invention to provide a supporting assembly capable of preventing a relative displacement of two brackets thereof.

According to an aspect of the present invention, a supporting assembly includes a first bracket, a second bracket, a locking member, a plurality of working features, a first mounting member and a second mounting member. The first bracket and the second bracket are displaceable relative to each other along a longitudinal direction. The locking member is movable between a locking state and an unlocking state relative to the first bracket. The plurality of working features are arranged on the second bracket. The first mounting member is arranged on the first bracket. The second mounting member is arranged on the second bracket. When the first bracket is located at a first predetermined position relative to the second bracket, the locking member in the locking state is configured to engage with one of the plurality of working features to maintain the first bracket at the first predetermined position relative to the second bracket, and the first mounting member and the second mounting member are spaced apart from each other by a first longitudinal distance. When the first bracket is located at a second predetermined position relative to the second bracket, the locking member in the locking state is configured to engage with another one of the plurality of working features to maintain the first bracket at the second predetermined position relative to the second bracket, and the first mounting member and the second mounting member are spaced apart from each other by a second longitudinal distance different from the first longitudinal distance.

According to another aspect of the present invention, a supporting assembly is adapted for a rack comprising a first post and a second post. The supporting assembly includes a rail member, a first bracket, a second bracket, a locking member, a working feature, a first mounting member and a second mounting member. The rail member includes a first side and a second side opposite to the first side, and the second side of the rail member is configured to support a carried object. The first bracket is arranged on the first side of the rail member. The second bracket is displaceable relative to the first bracket. The locking member is movable relative to the first bracket between a locking state and an unlocking state. The working feature is arranged on the second bracket. The first mounting member is arranged on the first bracket and configured to be mounted on the first post of the rack. The second mounting member is arranged on the second bracket and configured to be mounted on the second post of the rack. When the first bracket is located at a predetermined position relative to the second bracket, the locking member in the locking state is configured to engage with the working feature to maintain the first mounting member and the second mounting member being mounted on the first post and the second post of the rack, respectively, thereby preventing detachment of the supporting assembly from the rack.

According to another aspect of the present invention, a method of mounting a supporting assembly on a rack includes providing a first bracket and a second bracket, and arranging a plurality of working features on the second bracket; providing a locking member, and configuring the locking member in a locking state to engage with one of the plurality of working features to prevent the first bracket and the second bracket from displacing relative to each other; providing an operating member for operating the locking member; operating the operating member from a first position to a second position to drive the locking member from the locking state to an unlocking state for preventing the locking member from engaging with any of the plurality of working features, thereby allowing the first bracket and the second bracket to displace relative to each other; mounting the first bracket and the second bracket on a first post and a second post of the rack, respectively, so that the first bracket is located at a predetermined position relative to the second bracket; and releasing the operating member, so that the operating member moves from the second position to the first position to drive the locking member from the unlocking state to the locking state for engaging the locking member with a corresponding one of the plurality of working features, thereby preventing detachment of the first bracket from the first post of the rack and detachment of the second bracket from the second post of the rack.

In summary, the supporting assembly of the present invention utilizes a cooperation of the locking member and the working feature to prevent a relative displacement of the first bracket and the second bracket, and therefore, the supporting assembly of the present invention has enhanced operational convenience.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
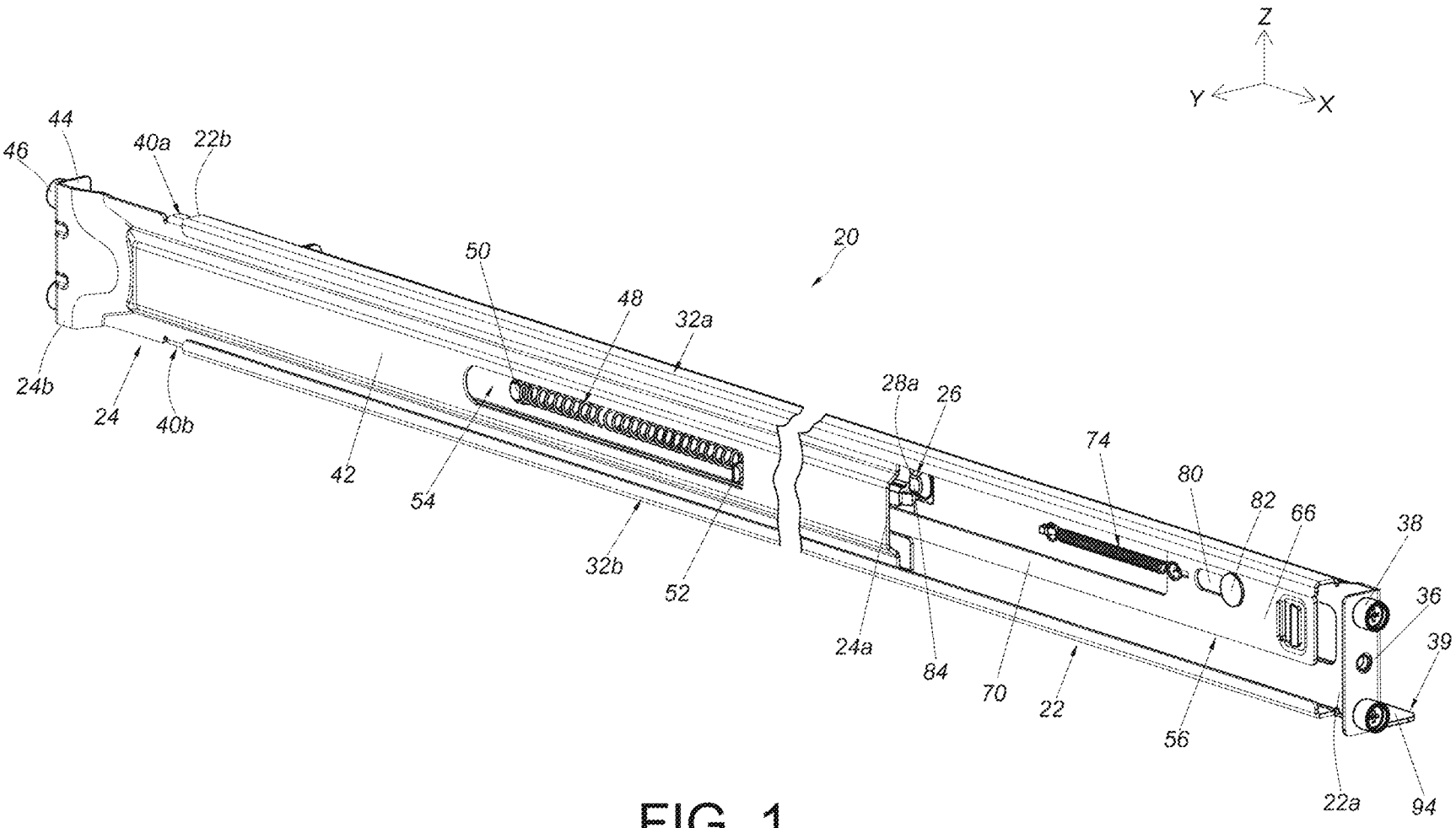
FIG. 1 is a schematic diagram of a supporting assembly according to an embodiment of the present invention.
Figure 2:
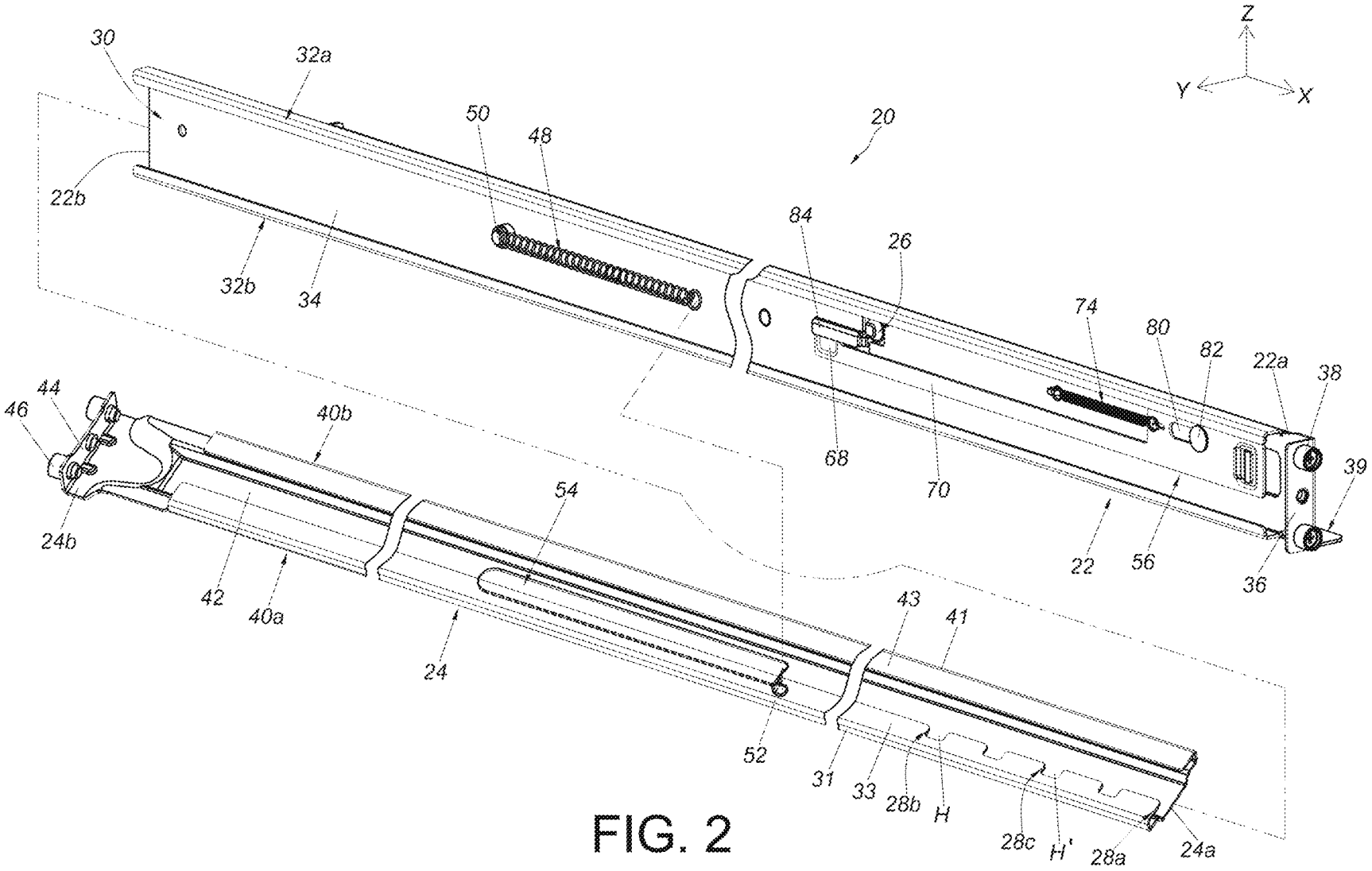
FIG. 2 is a partial exploded diagram of the supporting assembly according to the embodiment of the present invention.

As shown in FIG. 1 and FIG. 2, a supporting assembly 20 includes a first bracket 22, a second bracket 24, a locking member 26 and at least one working feature. The first bracket 22 and the second bracket 24 are displaceable relative to each other along a longitudinal direction. In this embodiment, by way of example, the at least one working feature includes a first working feature 28*a*, a second working feature 28*b* and a third working feature 28*c*, such that the locking member 26 can cooperate with, e.g., engage with, one of the first working feature 28*a*, the second working feature 28*b* and the third working feature 28*c*, thereby enabling the first bracket 22 to be maintained at one of three different predetermined positions relative to the second bracket 24. However, the number of the working feature of the present invention is not limited to this embodiment. For example, in another embodiment, there can be only one working feature, such as the first working feature 28*a*, the second working feature 28*b* or the third working feature 28*c*, for enabling the first bracket 22 to be maintained at a corresponding one predetermined position relative to the second bracket 24. Besides, in this embodiment, by way of example, the longitudinal direction can be defined by a length direction of a bracket, e.g., the first bracket 22 or the second bracket 24, and parallel to an X axis. A transverse direction can be defined by a lateral direction or a width direction of the bracket, e.g., the first bracket 22 or the second bracket 24, and parallel to a Y axis. A vertical direction can be defined by a height direction of the bracket, e.g., the first bracket 22 or the second bracket 24, and parallel to a Z axis.

One of the first bracket 22 and the second bracket 24 includes a channel 30 configured to movably mount the other one of the first bracket 22 and the second bracket 24. In this embodiment, by way of example, the first bracket 22 includes the channel 30, and the channel 30 is configured to movably mount the second bracket 24. Furthermore, the first bracket 22 includes a first edge plate 32*a*, a second edge plate 32*b* and a longitudinal wall 34 connected between the first edge plate 32*a* and the second edge plate 32*b* of the first bracket 22, and the first edge plate 32*a*, the second edge plate 32*b* and the longitudinal wall 34 cooperatively define the channel 30.

The first bracket 22 includes a first end portion 22*a* and a second end portion 22*b* opposite to the first end portion 22*a*. In this embodiment, by way of example, the first end portion 22*a* and the second end portion 22*b* of the first bracket 22 can be a front end portion and a rear end portion of the first bracket 22, respectively. However, the present invention is not limited to this embodiment. Preferably, the first bracket 22 further includes an end plate 36 located adjacent to the first end portion 22*a* of the first bracket 22 and substantially perpendicularly bent from the longitudinal wall 34 of the first bracket 22. At least one first mounting member 38 is arranged on the end plate 36.

Figure 11:
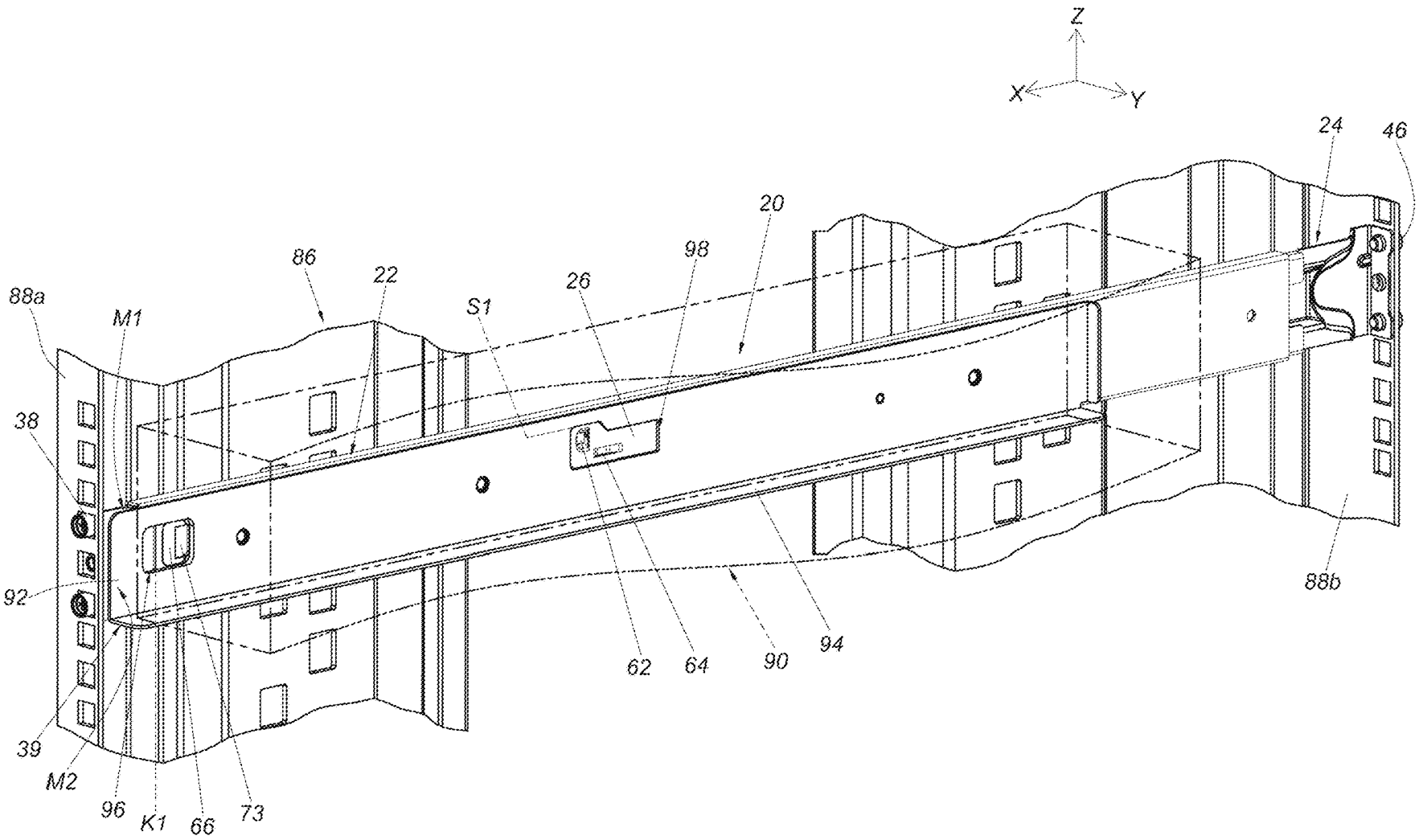
FIG. 11 is a diagram of the supporting assembly mounted on a rack while supporting a carried object according to the embodiment of the present invention.

Preferably, the supporting assembly 20 further includes a rail member 39, and the first bracket 22 is arranged on the rail member 39. In this embodiment, by way of example, as shown in FIG. 11, the rail member 39 is an L-shaped rail member. However, the present invention is not limited to this embodiment. Besides, in this embodiment, the first bracket 22 is connected, e.g., fixedly connected, to a side of the rail member 39, and therefore, the first bracket 22 and the rail member 39 can be considered as a single integral structure.

The second bracket 24 includes a first edge plate 40*a*, a second edge plate 40*b* and a longitudinal wall 42 connected between the first edge plate 40*a* and the second edge plate 40*b* of the second bracket 24. The second bracket 24 includes a first end portion 24*a* and a second end portion 24*b* opposite to the first end portion 24*a*. In this embodiment, by way of example, the first end portion 24*a* and the second end portion 24*b* of the second bracket 24 can be a front end portion and a rear end portion of the second bracket 24.

However, the present invention is not limited to this embodiment. Preferably, the second bracket 24 further includes an end plate 44 located adjacent to the second end portion 24*b* of the second bracket 24 and substantially perpendicularly bent from the longitudinal wall 42 of the second bracket 24. At least one second mounting member 46 is arranged on the end plate 44 of the second bracket 24. The longitudinal wall 42 of the second bracket 24 is at least partially mounted inside the channel 30 of the first bracket 22 through the second end portion 22*b* of the first bracket 22, and the second mounting member 46 is located outside the channel 30 of the first bracket 22.

Preferably, the first edge plate 40*a* of the second bracket 24 includes a first section 31 and a second section 33 bent from the first section 31 and toward the second edge plate 40*b* of the second bracket 24. Furthermore, the second edge plate 40*b* of the second bracket 24 includes a first portion 41 and a second portion 43 bent from the first portion 41 and toward the first edge plate 40*a* of the second bracket 24.

Preferably, the supporting assembly 20 further includes a resilient member 48 configured to provide a resilient force to one of the first bracket 22 and the second bracket 24. In this embodiment, by way of example, a first connecting feature 50 and a second connecting feature 52 are arranged on the first bracket 22 and the second bracket 24, respectively, and the resilient member 48 is mounted between the first connecting feature 50 and the second connecting feature 52. Besides, in this embodiment, the first connecting feature 50 and the second connecting feature 52 can be protruding objects. However, the present invention is not limited to this embodiment.

Preferably, an excavating space 54 is formed on the longitudinal wall 42 of the second bracket 24 and located at a position corresponding to the resilient member 48.

The first working feature 28*a*, the second working feature 28*b* and the third working feature 28*c* are arranged on the second bracket 24. In this embodiment, by way of example, the first working feature 28*a*, the second working feature 28*b* and the third working feature 28*c* are arranged on the second section 33 of the first edge plate 40*a* of the second bracket 24. However, the present invention is not limited to this embodiment.

Preferably, the first working feature 28*a*, the second working feature 28*b* and the third working feature 28*c* are arranged on the second bracket 24 at intervals along the longitudinal direction, and the third working feature 28*c* is located between the first working feature 28*a* and the second working feature 28*b*. For example, each of the first working feature 28*a*, the second working feature 28*b* and the third working feature 28*c* can be a wall. Preferably, in this embodiment, the first working feature 28*a*, the second working feature 28*b*, and the third working feature 28*c* can be an end wall of the first edge plate 40*a* of the second bracket 24, an inner wall of a predetermined hole H, and an inner wall of another predetermined hole H', respectively. However, the present invention is not limited to this embodiment. For example, in another embodiment, the first working feature 28*a*, the second working feature 28*b* and the third working feature 28*c* can be an inner wall of a first predetermined hole, an inner wall of a second predetermined hole, and an inner wall of a third predetermined hole.

Figure 3B:
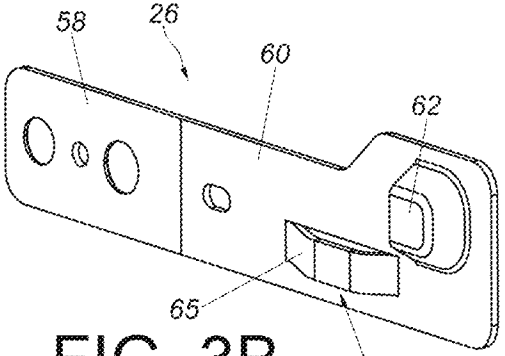
FIG. 3B is a diagram of a locking member according to the embodiment of the present invention.
Figure 3A:
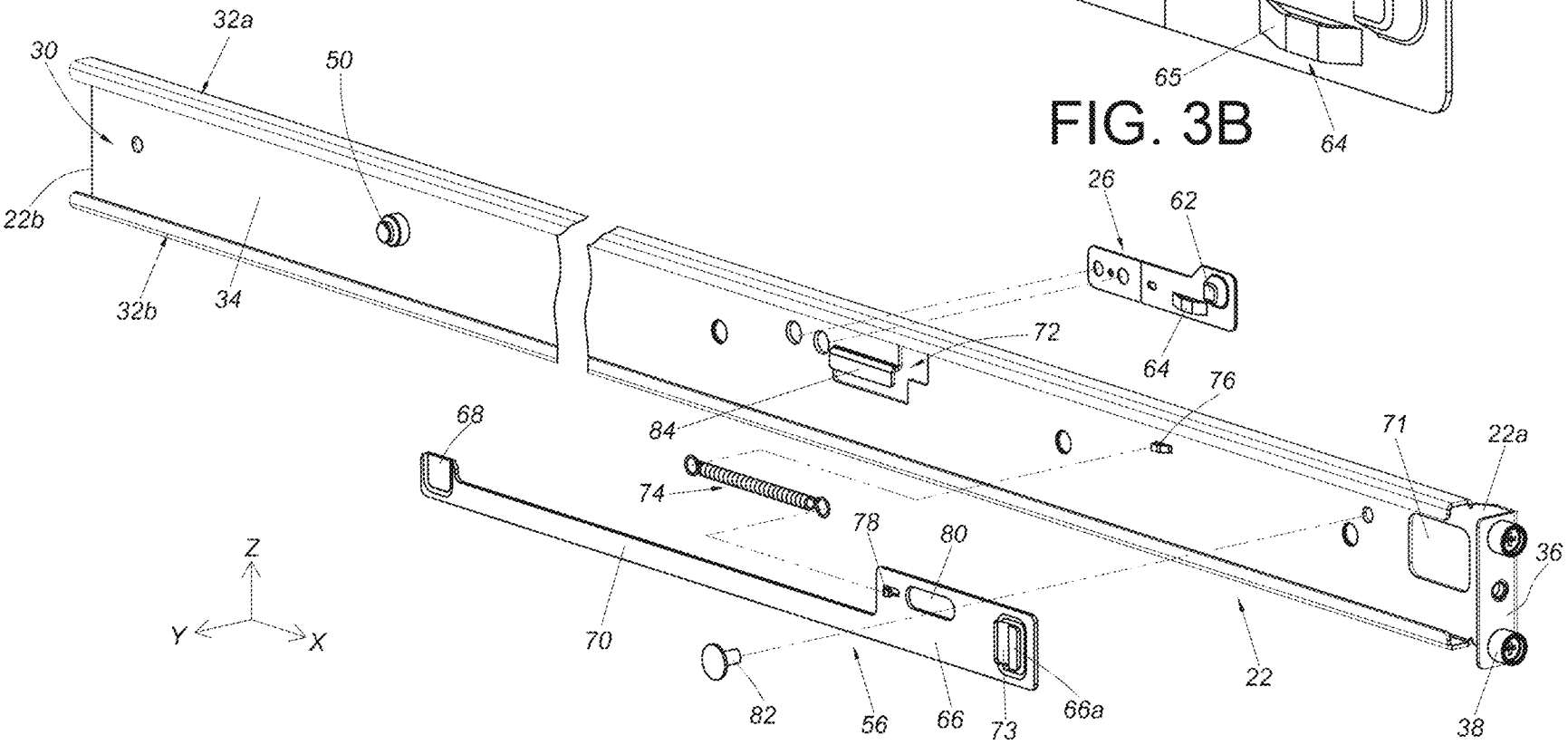
FIG. 3A is another partial exploded diagram of the supporting assembly according to the embodiment of the present invention.
Figure 4:
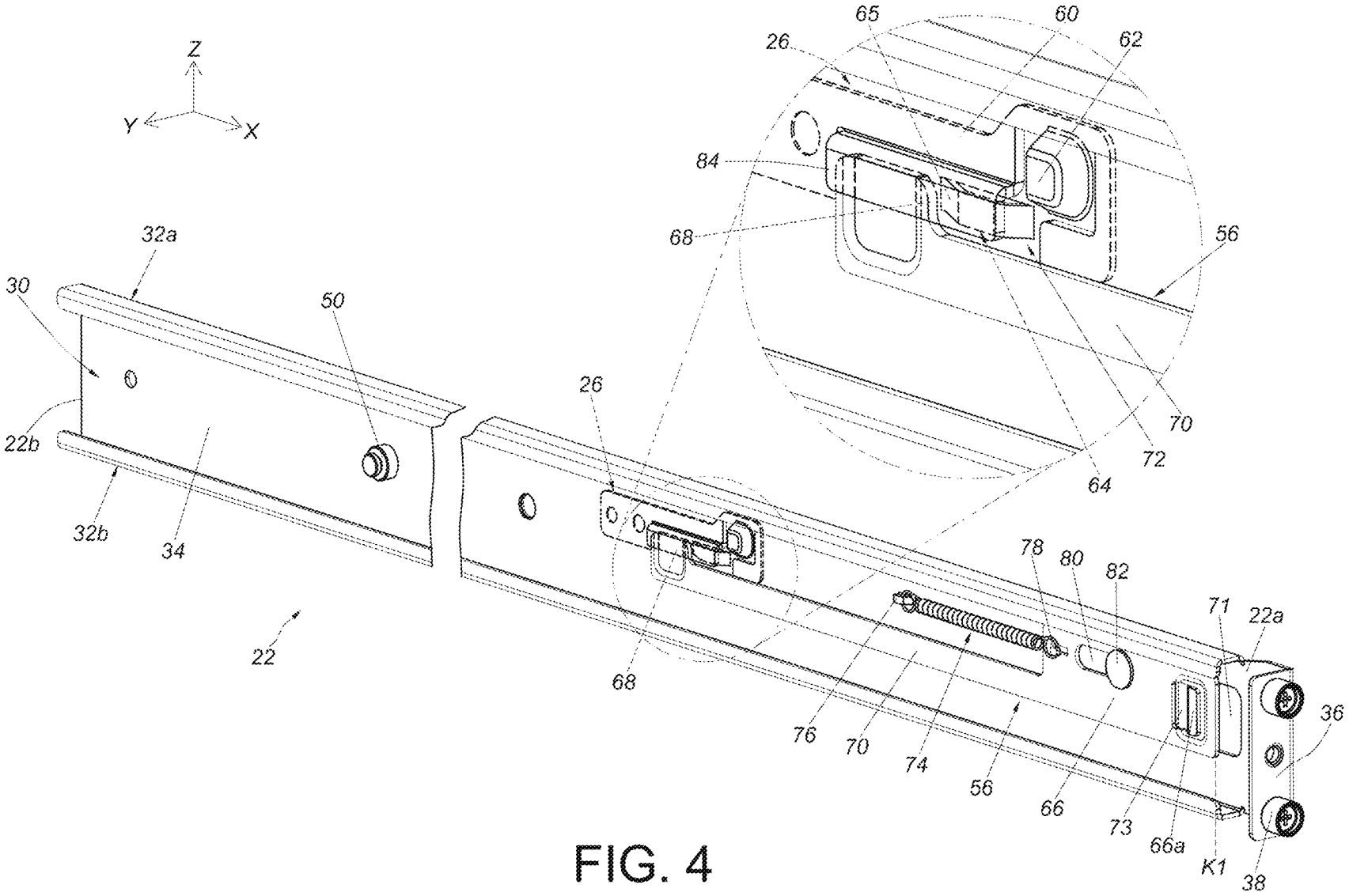
FIG. 4 is a partial diagram of the supporting assembly according to the embodiment of the present invention.

As shown in FIG. 3A, FIG. 3B and FIG. 4, the locking member 26 is arranged on the first bracket 22. Preferably, the supporting assembly 20 further includes an operating member 56 configured to operate the locking member 26.

The locking member 26 includes a connecting portion 58, a resilient portion 60, a locking portion 62 and a corresponding portion 64. The connecting portion 58 is connected, e.g., fixedly connected, to the first bracket 22. The resilient portion 60 extends from the connecting portion 58. The locking portion 62 and the corresponding portion 64 are arranged on the resilient portion 60. Preferably, in this embodiment, the corresponding portion 64 includes a guiding section 65, and the guiding section 65 can be, for example, an inclined surface or an arc surface. However, the present invention is not limited to this embodiment.

The operating member 56 includes an operating portion 66, a driving portion 68 and an extending section 70 connected between the operating portion 66 and the driving portion 68. The operating portion 66 is located adjacent to the first end portion 22*a* of the first bracket 22 to facilitate a user, for example, standing in front of the supporting assembly 20, to operate the operating member 56, thereby enhancing operational convenience. In this embodiment, the operating portion 66 is provided with an operating section 66*a*, and the operating section 66*a* is bent from the operating portion 66 for facilitating the user to operate the operating member 56. The driving portion 68 is configured to cooperate with the corresponding portion 64, e.g., the guiding section 65 of the corresponding portion 64. The extending section 70 is oriented substantially parallel to the longitudinal direction of the first bracket 22, i.e., the X axis.

Preferably, the locking member 26 and the operating member 56 are located at two sides, e.g., two opposite sides, of the first bracket 22, and an opening 72 is formed on the first bracket 22 and communicated with the two sides of the first bracket 22. The locking portion 62 and the corresponding portion 64 of the locking member 26 penetrate through the opening 72 from one side of the first bracket 22 to the other side of the first bracket 22. The driving portion 68 of the operating member 56 is located at a position corresponding to the corresponding portion 64 of the locking member 26. For example, the driving portion 68 of the operating member 56 can be aligned with the guiding section 65 of the corresponding portion 64 of the locking member 26 along the longitudinal direction.

Preferably, an auxiliary hole 71 is further formed on the first bracket 22 and communicated with the two sides of the first bracket 22. The auxiliary hole 71 is located at a position corresponding to a part of the operating portion 66. Preferably, a through hole 73 is formed on the operating portion 66 of the operating member 56, and the through hole 73 is located at a position corresponding to the auxiliary hole 71 and communicated with the auxiliary hole 71.

Preferably, the supporting assembly 20 further includes a recovering resilient member 74 configured to provide a recovering resilient force to the operating member 56. For example, the operating member 56 can be maintained at a first position K1 in response to the recovering resilient force provided by the recovering resilient member 74. The recovering resilient member 74 is mounted between a first connecting section 76 of the first bracket 22 and a second connecting section 78 of the operating member 56.

Preferably, the operating member 56 can move relative to the first bracket 22 only within a limited range by a cooperation of a first restraining feature 80 and a second restraining feature 82. For example, one of the first restraining feature 80 and the second restraining feature 82 can be a longitudinal elongated hole or a longitudinal elongated slot, and the other one of the first restraining feature 80 and the second restraining feature 82 can be a protruding object, such as a pin, penetrating through a portion of the longitudinal elongated hole or the longitudinal elongated slot.

Preferably, an auxiliary section 84 is further arranged on the first bracket 22 and bent from the longitudinal wall 34 of the first bracket 22. The auxiliary section 84 is located adjacent to the driving portion 68 of the operating member 56. The auxiliary section 84 is configured to prevent the operating member 56 from moving along the transverse direction or the lateral direction.

Figure 5:
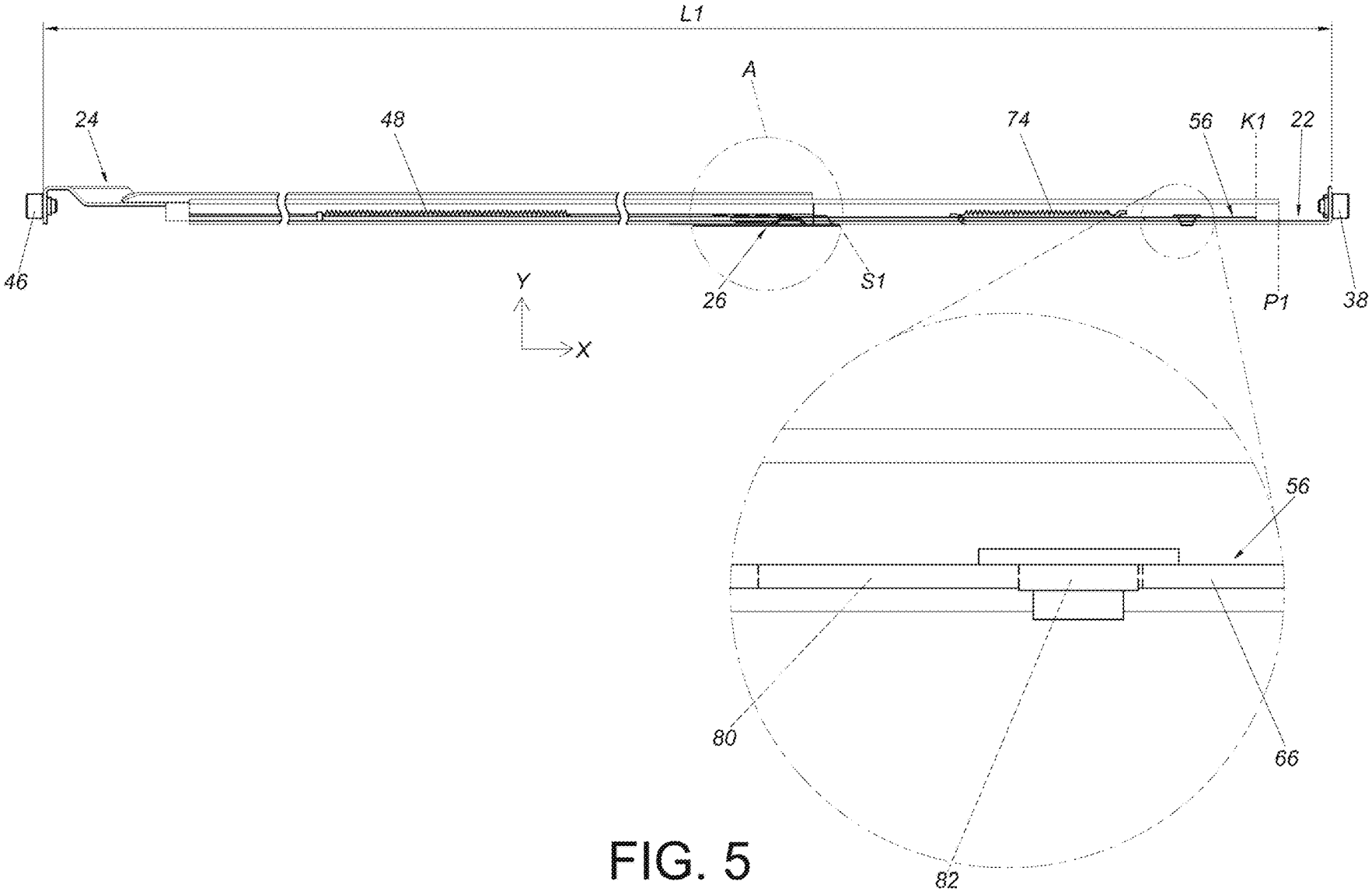
FIG. 5 is a diagram of the supporting assembly showing a first bracket is maintained at a first predetermined position relative to a second bracket according to the embodiment of the present invention.
Figure 6:
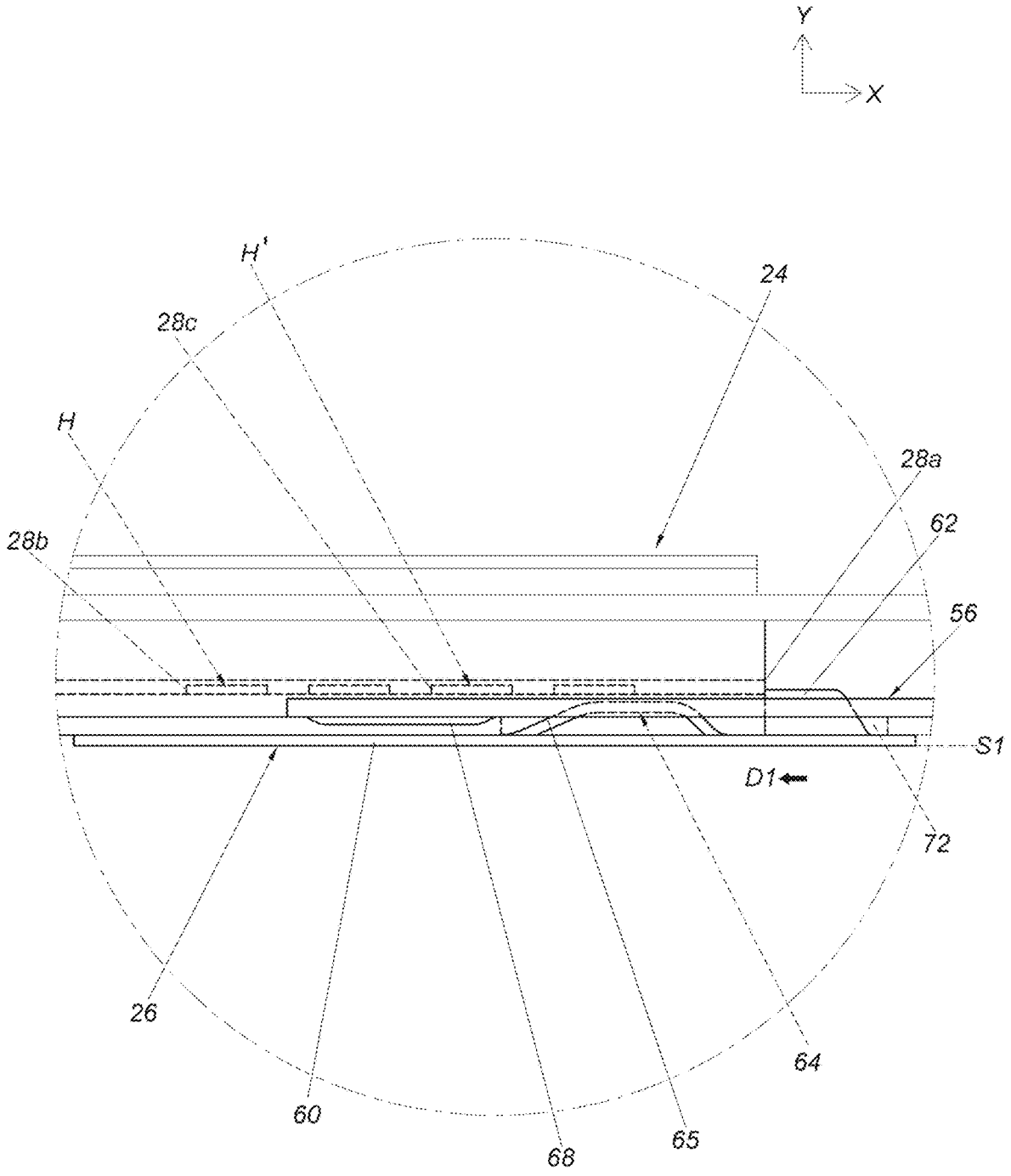
FIG. 6 is an enlarged diagram of an A portion of the supporting assembly shown in FIG. 5 according to the embodiment of the present invention.

As shown in FIG. 5 and FIG. 6, the first bracket 22 is located at a predetermined position, e.g., a first predetermined position P1 relative to the second bracket 24.

Furthermore, when the first bracket 22 is located at the first predetermined position P1 relative to the second bracket 24, the locking portion 62 of the locking member 26 in a locking state S1 is configured to engage with the first working feature 28*a*, such that the first bracket 22 is maintained at the first predetermined position P1 relative to the second bracket 24, thereby preventing a relative displacement of the first bracket 22 and the second bracket 24, e.g., preventing a displacement of the first bracket 22 relative to the second bracket 24 along a predetermined direction D1. Besides, at this moment, the first mounting member 38 and the second mounting member 46 are spaced apart from each other by a first longitudinal distance L1. Furthermore, as shown in FIG. 5 and FIG. 6, the operating member 56 is located at the first position K1, such that the driving portion 68 of the operating member 56 is located adjacent to the guiding section 65 of the corresponding portion 64 of the locking member 26.

Figure 7:
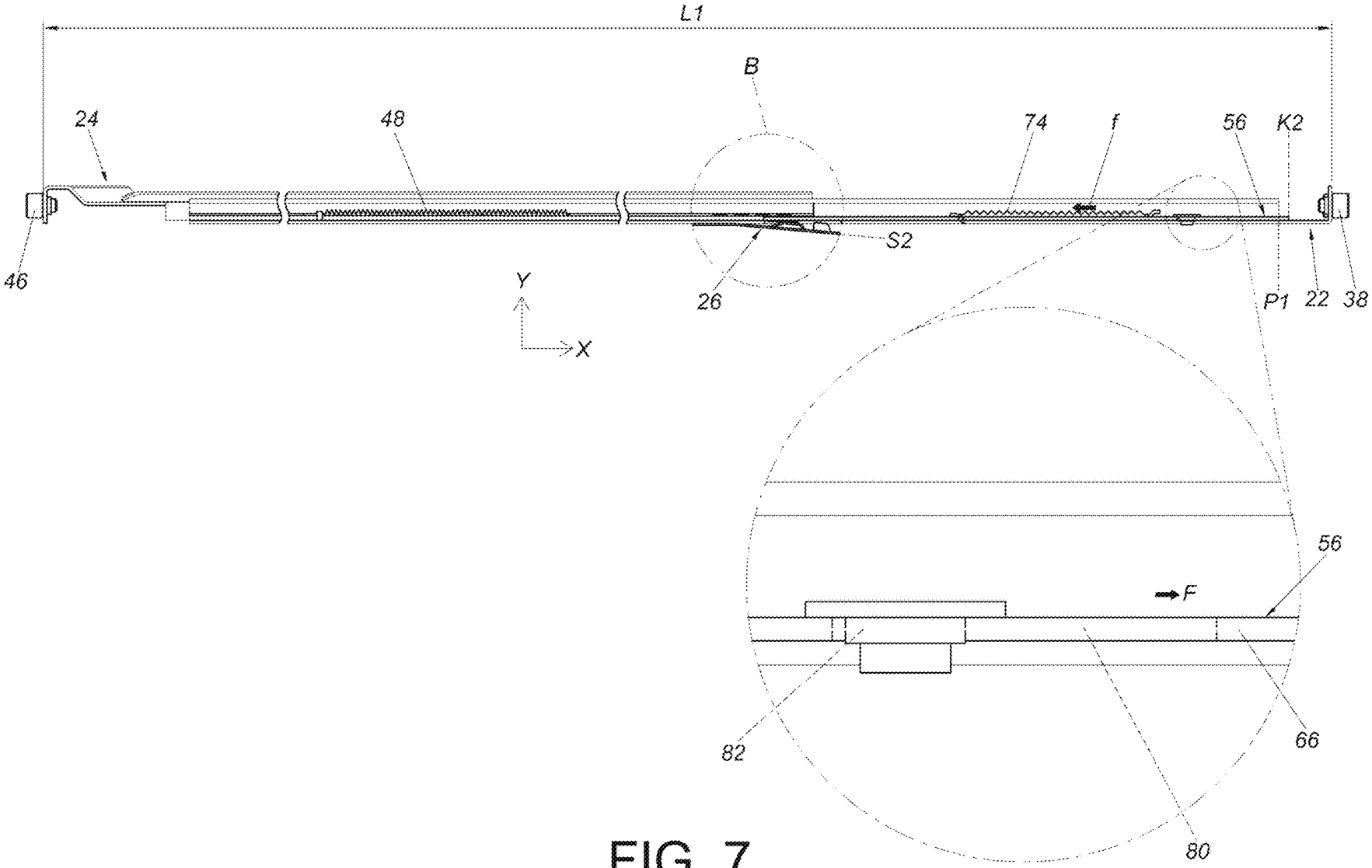
FIG. 7 is a diagram of the supporting assembly showing the first bracket is not maintained at the first predetermined position relative to the second bracket according to the embodiment of the present invention.
Figure 8:
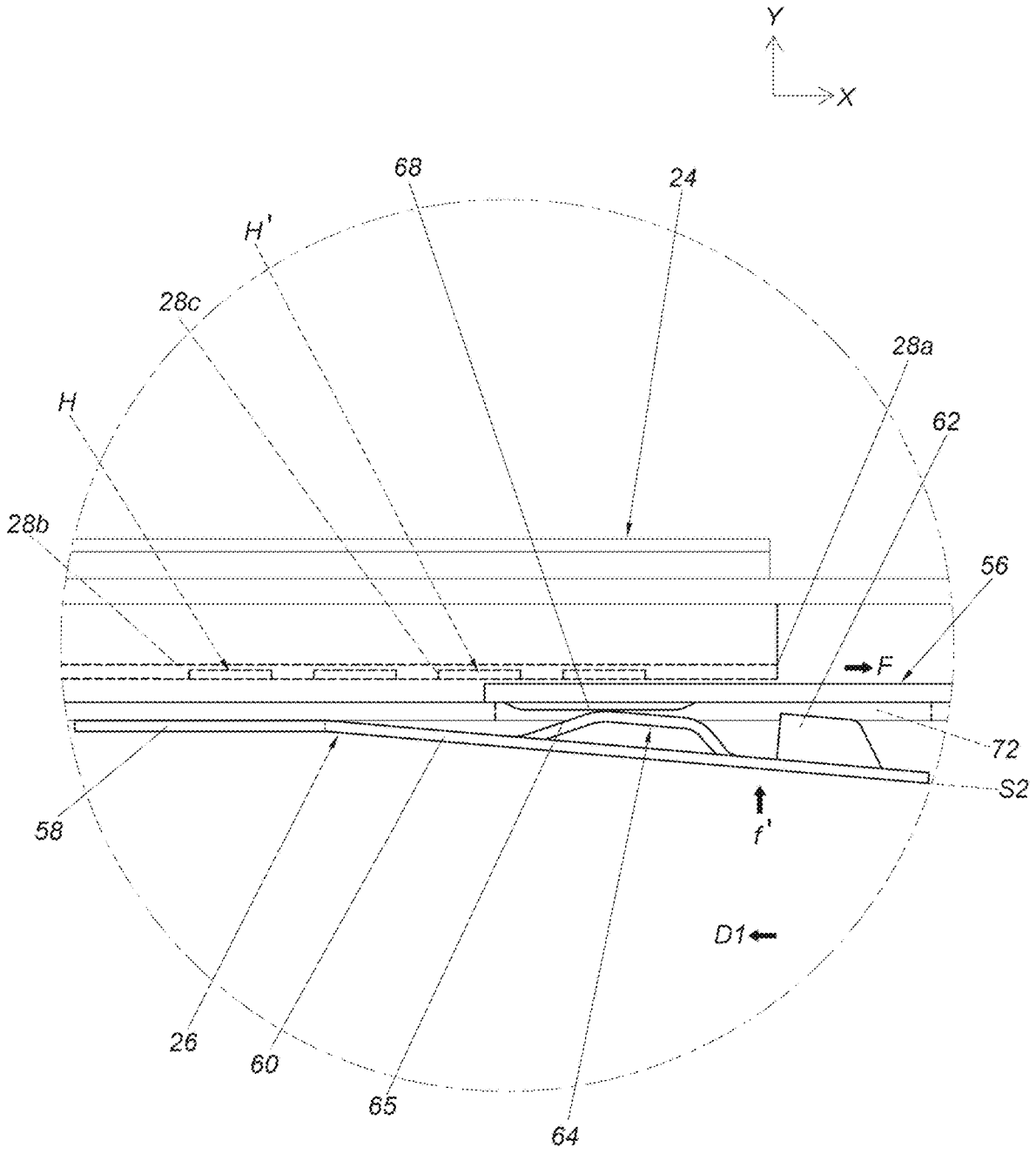
FIG. 8 is an enlarged diagram of a B portion of the supporting assembly shown in FIG. 7 according to the embodiment of the present invention.

As shown in FIG. 7 and FIG. 8, when the locking member 26 is operated from the locking state S1 to an unlocking state S2, the first bracket 22 and the second bracket 24 can displace relative to each other, thereby enabling the first bracket 22 to move away from the first predetermined position P1 relative to the second bracket 24.

For example, the user can operate the operating member 56 with a force F to move the operating member 56 from the first position K1 to a second position K2, for overcoming the recovering resilient force provided by the recovering resilient member 74. When the operating member 56 moves from the first position K1 to the second position K2, the driving portion 68 of the operating member 56 abuts against the guiding section 65 of the corresponding portion 64 of the locking member 26 to drive the locking member 26 from the locking state S1 to the unlocking state S2 to disengage the locking portion 62 of the locking member 26 from the first working feature 28*a*, thereby allowing a relative displacement of the first bracket 22 and the second bracket 24, e.g., allowing a displacement of the first bracket 22 relative to the second bracket 24 along the predetermined direction D1 longitudinally.

It should be noticed that, when the operating member 56 is moved to the second position K2 by the force F, the recovering resilient member 74 accumulates a recovering resilient force f. Besides, at this moment, since the corresponding portion 64 of the locking member 26 is abutted by the driving portion 68 of the operating member 56 at the second position K2, the resilient portion 60 of the locking member 26 accumulates a resilient force f'.

Figure 9:
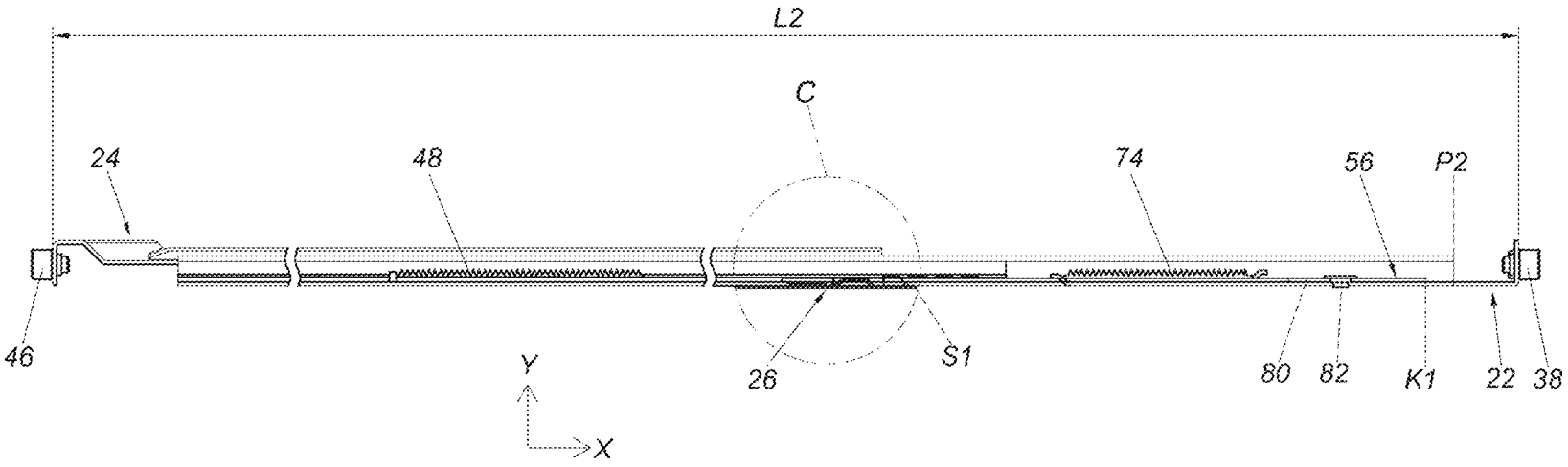
FIG. 9 is a diagram of the supporting assembly showing the first bracket is maintained at a second predetermined position relative to the second bracket according to the embodiment of the present invention.
Figure 10:
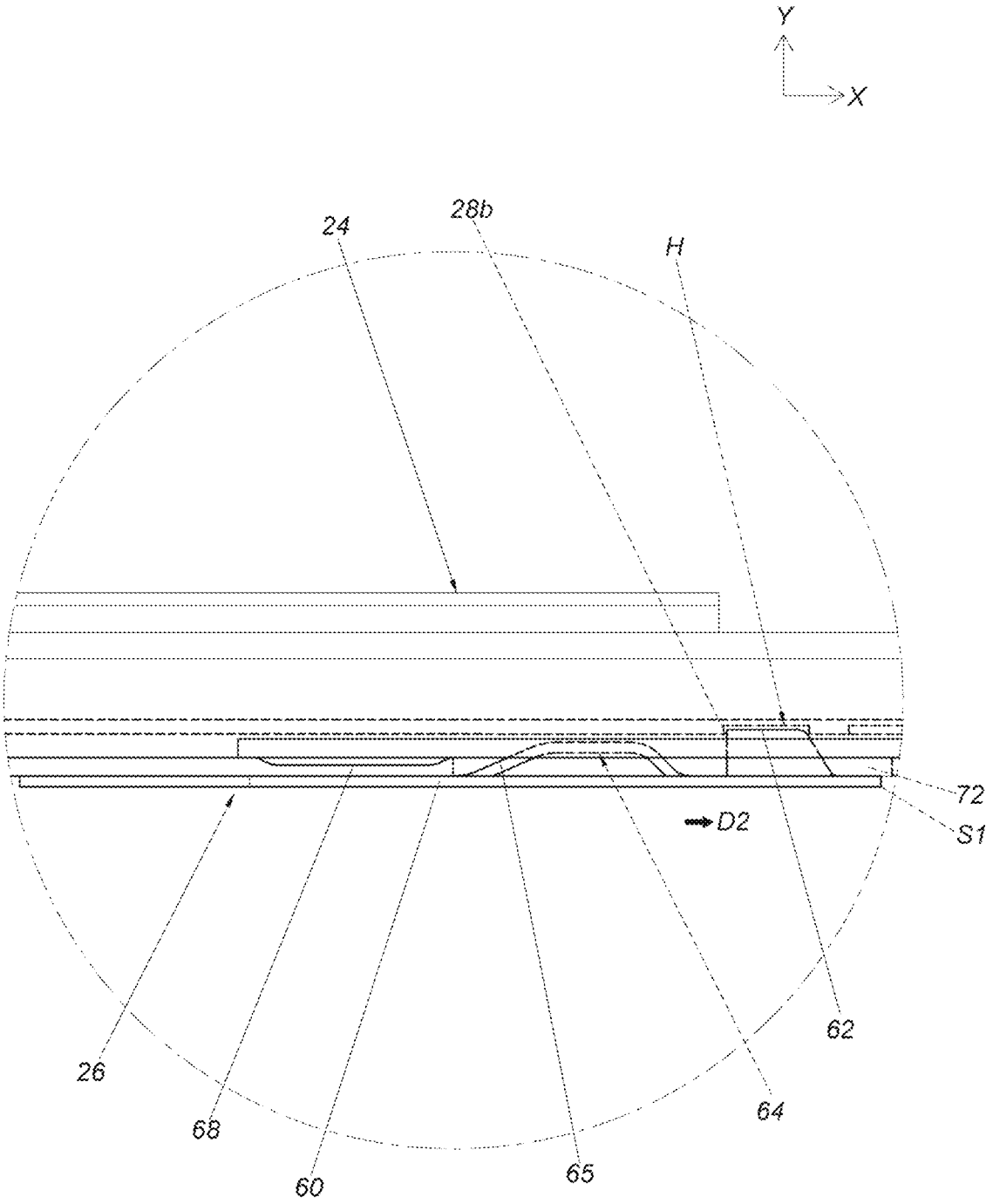
FIG. 10 is an enlarged diagram of a C portion of the supporting assembly shown in FIG. 9 according to the embodiment of the present invention.

As shown in FIG. 9 and FIG. 10, when the first bracket 22 is located at another predetermined position, e.g., a second predetermined position P2, relative to the second bracket 24, the locking portion 62 of the locking member 26 in the locking state S1 is configured to engage with the second working feature 28*b* to prevent a relative displacement of the first bracket 22 and the second bracket 24, thereby maintaining the first bracket 22 at the second predetermined position P2 relative to the second bracket 24. Besides, at this moment, the first mounting member 38 and the second mounting member 46 are spaced apart from each other by a second longitudinal distance L2 different from the first longitudinal distance L1. In this embodiment, by way of example, the second longitudinal distance L2 is less than the first longitudinal distance L1. However, the present invention is not limited to this embodiment.

Specifically, after the locking portion 62 of the locking member 26 disengages from the first working feature 28*a*, the first bracket 22 can be displaced relative to the second bracket 24 from the first predetermined position P1 to the second predetermined position P2. Afterwards, when the first bracket 22 is located at second predetermined position P2 relative to the second bracket 24, the operating member 56 can be released to return from the second position K2 to the first position K1 in response to the recovering resilient force f provided by the recovering resilient member 74, such that the corresponding portion 64 of the locking member 26 is no longer abutted by the driving portion 68 of the operating member 56. As a result, the locking member 26 moves from the unlocking state S2 to the locking state S1 in response to the resilient force f' provided by the resilient portion 60 of the locking member 26 to enable the locking portion 62 of the locking member 26 to enter the predetermined hole H and engage with the second working feature 28*b*, thereby maintaining the first bracket 22 at the second predetermined position P2 relative to the second bracket 24.

It should be noticed that, when the operating member 56 is operated to the second position K2 again, the locking portion 62 of the locking member 26 can be driven to disengage from the second working feature 28*b*, thereby allowing the first bracket 22 to displace relative to the second bracket 24 away from the second predetermined position P2 along another predetermined direction D2 opposite to the predetermined direction D1.

Accordingly, it can be understood that, when the locking member 26 is driven from the locking state S1 to the unlocking state S2 by moving the operating member 56 to the second position K2, the locking portion 62 of the locking member 26 is prevented from engaging with the first working feature 28*a* and/or the second working feature 28*b*, such that the first bracket 22 can be displaced relative to the second bracket 24 between the first predetermined position P1 and the second predetermined position P2.

As shown in FIG. 11, the rail member 39 includes a first side M1 and a second side M2 opposite to the first side M1. The first bracket 22 is connected, e.g., fixedly connected, to the first side M1 of the rail member 39. The second side M2 of the rail member 39 is configured to support a carried object 90, such as a server chassis. Besides, the first bracket 22 is configured be mounted on a first post 88*a* of a rack 86 by an inserting engagement of the first mounting member 38 with a hole on the first post 88*a*, and the second bracket 24 is configured be mounted on a second post 88*b* of the rack 86 by an inserting engagement of the second mounting member 46 with a hole on the second post 88*b*.

Furthermore, in this embodiment, by way of example, when the first bracket 22 and the second bracket 24 are mounted on the first post 88*a* and the second post 88*b* of the rack 86, respectively, the first bracket 22 can be located at the second predetermined position P2, and the locking portion 62 of the locking member 26 in the locking state S1 can engage with the second working feature 28*b* (as shown in FIG. 9 and FIG. 10), thereby securing the first bracket 22 and the second bracket 24 to the first post 88*a* and the second post 88*b*, respectively, and preventing unintentional detachment of the supporting assembly 20 from the rack 86.

However, the present invention is not limited to this embodiment. For example, in another embodiment, depending on a distance between the first post 88*a* and the second post 88*b* of the rack 86, the first bracket 22 can be located at the first predetermined position P1 and the locking portion 62 of the locking member 26 in the locking state S1 can engage with the first working feature 28*a* (as shown in FIG. 5 and FIG. 6) when the first bracket 22 and the second bracket 24 are mounted on the first post 88*a* and the second post 88*b* of the rack 86, respectively.

Preferably, the rail member 39 includes a longitudinal portion 92 and a supporting portion 94 substantially perpendicularly connected to the longitudinal portion 92, such that rail member 39 is formed in an L shape. The supporting portion 94 is configured to support the carried object 90. However, the shape and the configuration of the rail member 39 of the present invention are not limited to this embodiment. For example, in another embodiment, practically, the rail member 39 can be a slide rail including two or more C-shaped slide segments for supporting the carried object 90.

Preferably, a first hole 96 is formed on the longitudinal portion 92 of the rail member 39 and communicated with the auxiliary hole 71 on the first bracket 22. Accordingly, the operating portion 66 of the operating member 56 can be exposed on the second side M2 of the rail member 39 through the first hole 96 to facilitate the user to operate the operating member 56 to enable a relative displacement of the first bracket 22 and the second bracket 24.

Preferably, by the resilient force provided by the resilient member 48 to one of the first bracket 22 and the second bracket 24, it not only facilitates the inserting engagement of the first mounting member 38 with the hole on the first post 88*a* and the inserting engagement of the second mounting member 46 with the hole on the second post 88*b* when the first bracket 22 and the second bracket 24 are mounted on the first post 88*a* and the second post 88*b* of the rack 86, respectively, but also enhances the mounting safety and reliability of the first bracket 22 and the second bracket 24 relative to the rack 86.

Figure 12:
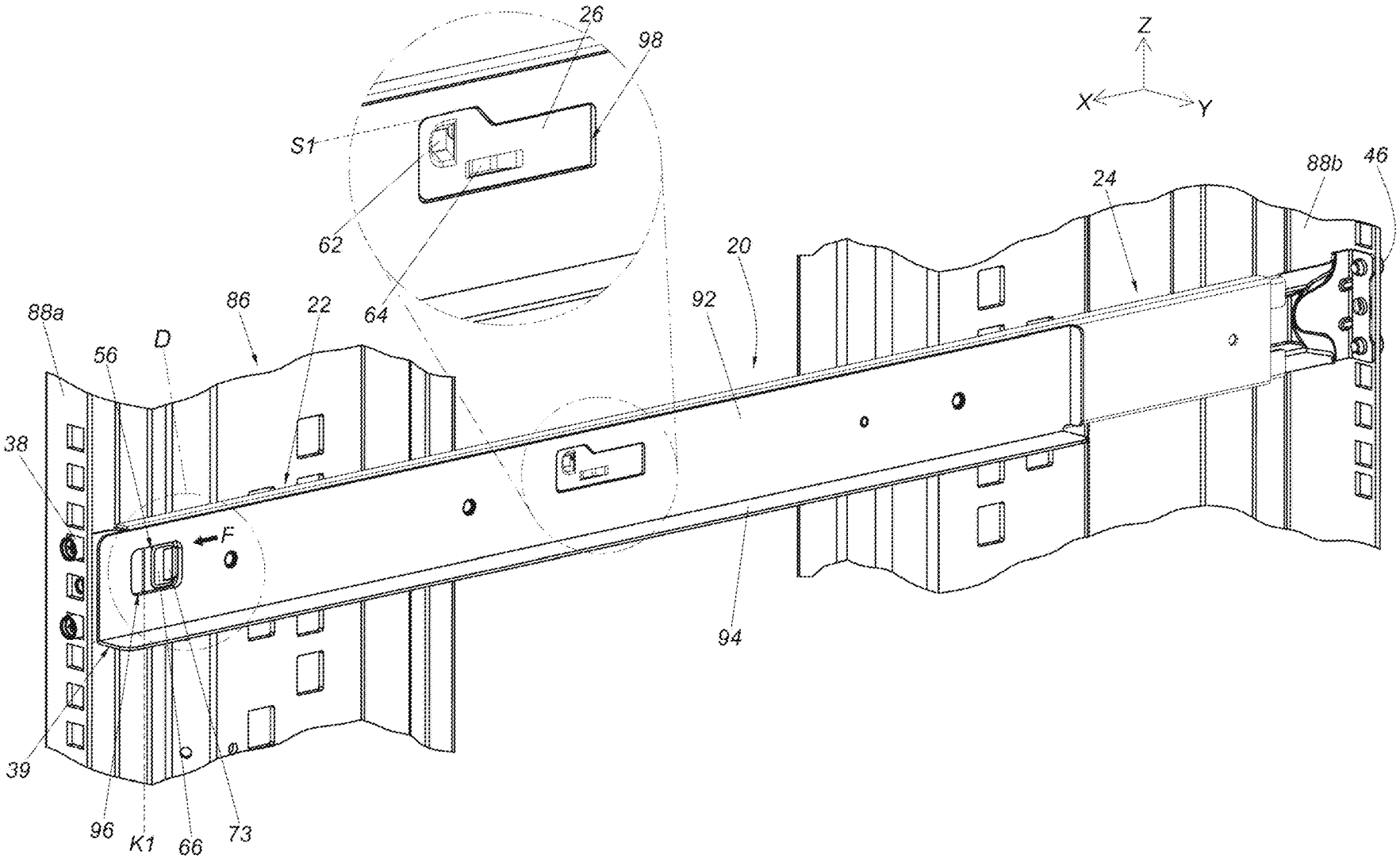
FIG. 12 is a diagram of the supporting assembly mounted on the rack according to the embodiment of the present invention.
Figure 13:
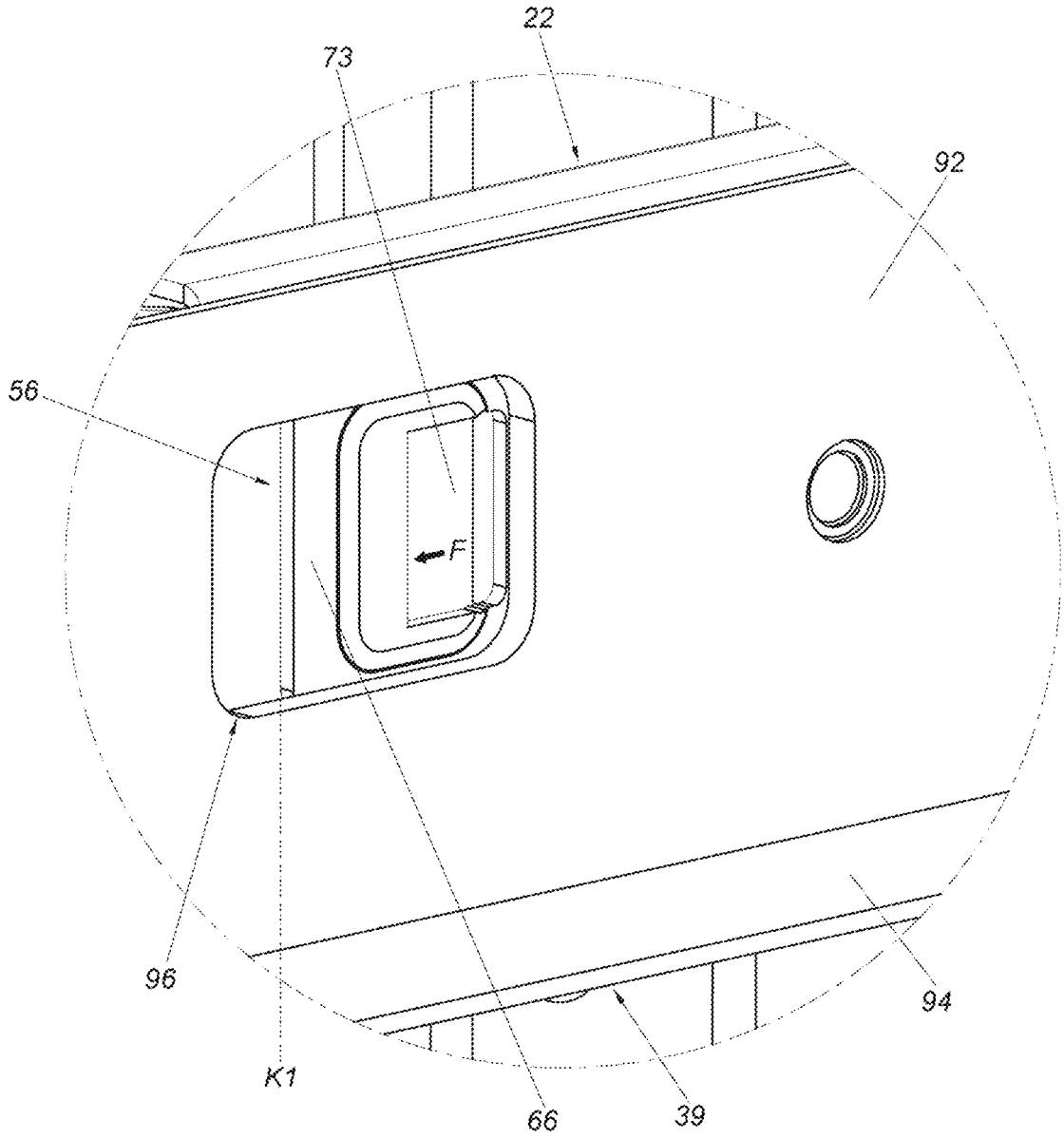
FIG. 13 is an enlarged diagram of a D portion of the supporting assembly shown in FIG. 12 according to the embodiment of the present invention.

As shown in FIG. 12 and FIG. 13, after the carried object 90 is detached from the supporting portion 94 of the rail member 39, the user can operate the operating portion 66 of the operating member 56 with the force F to move the operating member 56 from the first position K1 to the second position K2 to drive the locking member 26 from the locking state S1 to the unlocking state S2, thereby disengaging the locking portion 62 of the locking member 26 from the second working feature 28*b*. Afterwards, the first bracket 22 and the second bracket 24 can be displaced relative to each other to disengage, e.g., withdraw, the first mounting member 38 and the second mounting member 46 from the hole on the first post 88*a* and the hole on the second post 88*b*, respectively, so as to detach the supporting assembly 20 from the rack 86.

Preferably, a second hole 98 is further formed on the longitudinal portion 92 of the rail member 39 and communicated with the opening 72 on the first bracket 22, so as to provide a moving space for the locking member 26 to move between the locking state S1 and the unlocking state S2 without any interference.

Based on the above disclosure, a method of mounting the supporting assembly 20 on the rack 86 can be summarized as the following steps:

S1: Provide the first bracket 22 and the second bracket 24, and arrange a plurality of working features, e.g., the first working feature 28*a*, the second working feature 28*b* and the third working feature 28*c*, on the second bracket 24;

S2: Provide the locking member 26, and configure the locking member 26 in the locking state S1 to engage with one of the plurality of working features, e.g., the first working feature 28*a*, to prevent the first bracket 22 and the second bracket 24 from displacing relative to each other;

S3: Provide the operating member 56 for operating the locking member 26;

S4: Operate the operating member 56 from the first position K1 to the second position K2 to drive the locking member 26 from the locking state S1 to the unlocking state S2 for preventing the locking member 26 from engaging with any of the plurality of working features, e.g., the first working feature 28*a*, thereby allowing the first bracket 22 and the second bracket 24 to displace relative to each other;

S5: Mount the first bracket 22 and the second bracket 24 on the first post 88*a* and the second post 88*b* of the rack 86, respectively, so that the first bracket 22 is located at a corresponding predetermined position, e.g., the second predetermined position P2, relative to the second bracket 24 (as shown in FIG. 12); and S6: Release the operating member 56, so that the operating member 56 moves from the second position K2 to the first position K1 to drive the locking member 26 from the unlocking state S2 to the locking state S1 for engaging the locking member 26 with a corresponding one of the plurality of working features, e.g., the second working feature 28*b*, thereby preventing detachment of the first bracket 22 from the first post 88*a* of the rack 86 and detachment of the second bracket 24 from the second post 88*b* of the rack 86 (as shown in FIG. 9, FIG. 10 and FIG. 12).

Preferably, the method further includes the following step:

S7: Operate the operating member 56 from the first position K1 to the second position K2 again to drive the locking member 26 from the locking state S1 to the unlocking state S2 for allowing the first bracket 22 and the second bracket 24 to displace relative to each other, thereby allowing the detachment of the first bracket 22 from the first post 88*a* of the rack 86 and the detachment of the second bracket 24 from the second post 88*b* of the rack 86.

The structural relationships and the operational principles of the structures described in the aforementioned steps S1 to S6 have been discussed in the preceding paragraphs with reference to at least FIG. 5 to FIG. 10 and FIG. 12. Detailed description is omitted herein for simplicity.

From the above, the supporting assembly 20 of the present invention includes the following characteristics.

1. The locking member 26 can cooperate with one of the plurality of working features, such as the first working feature 28*a* or the second working feature 28*b*, to prevent a relative displacement of the first bracket 22 and the second bracket 24, and preferably, the locking member 26 can be further operated by the operating member 56 to enable the first bracket 22 and the second bracket 24 to displace each other. Therefore, the supporting assembly 20 has enhanced operational convenience.
2. After the first mounting member 38 and the second mounting member 46 respectively engage with the hole on the first post 88*a* and the hole on the second post 88*b* of the rack 86 in inserting manners by a relative displacement of the first bracket 22 and the second bracket 24 along the longitudinal direction, the locking member 26 can be used to engage with one of the plurality of working features to prevent a further relative movement of the first bracket 22 and the second bracket 24, thereby preventing unintentional detachment of the first bracket 22 and the second bracket 24 from the rack 86. In other words, the first bracket 22 and the second bracket 24 of the supporting assembly 20 can be mounted on the rack 86 without any additional member, such as a hook member, a clip member or a fastening member, and therefore, the supporting assembly 20 has enhanced mounting convenience and safety.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A supporting assembly comprising:

a first bracket;

a second bracket, the first bracket and the second bracket being displaceable relative to each other along a longitudinal direction;

a locking member movable between a locking state and an unlocking state relative to the first bracket;

a plurality of working features arranged on the second bracket;

a resilient member configured to provide a resilient force to one of the first bracket and the second bracket;

a first mounting member arranged on the first bracket; and a second mounting member arranged on the second bracket;

wherein when the first bracket is located at a first predetermined position relative to the second bracket, the locking member in the locking state is configured to engage with one of the plurality of working features to maintain the first bracket at the first predetermined position relative to the second bracket, and the first mounting member and the second mounting member are spaced apart from each other by a first longitudinal distance;

wherein when the first bracket is located at a second predetermined position relative to the second bracket, the locking member in the locking state is configured to engage with another one of the plurality of working features to maintain the first bracket at the second predetermined position relative to the second bracket, and the first mounting member and the second mounting member are spaced apart from each other by a second longitudinal distance different from the first longitudinal distance.

2. The supporting assembly of claim 1, further comprising a rail member, the first bracket being arranged on a first side of the rail member, and the locking member being arranged on one of the first bracket and the rail member.

3. The supporting assembly of claim 2, wherein one of the first bracket and the second bracket comprises a channel for movably mounting another one of the first bracket and the second bracket.

4. The supporting assembly of claim 2, wherein the first bracket and the second bracket are configured to be mounted on a first post and a second post of a rack by the first mounting member and the second mounting member, respectively.

5. The supporting assembly of claim 4, wherein the rail member further comprises a second side opposite to the first side, and the second side of the rail member is configured to support a carried object.

6. The supporting assembly of claim 1, wherein the plurality of working features are arranged on the second bracket at intervals along the longitudinal direction.

7. The supporting assembly of claim 1, further comprising an operating member configured to operate the locking member from the locking state to the unlocking state for disengaging the locking member from any of the plurality of working features, thereby allowing the first bracket to move between the first predetermined position and the second predetermined position relative to each other by a relative displacement of the first bracket and the second bracket.

8. The supporting assembly of claim 7, wherein the operating member comprises an operating portion located adjacent to an end portion of the first bracket.

9. The supporting assembly of claim 7, further comprising a recovering resilient member configured to provide a recovering resilient force to the operating member.

10. The supporting assembly of claim 1, wherein each of the first bracket and the second bracket comprises a longitudinal wall and an end plate perpendicularly bent from the longitudinal wall, the first mounting member is arranged on the end plate of the first bracket, and the second mounting member is arranged on the end plate of the second bracket.

11. A supporting assembly adapted for a rack comprising a first post and a second post, the supporting assembly comprising:

a rail member comprising a first side and a second side opposite to the first side, and the second side of the rail member being configured to support a carried object;

a first bracket arranged on the first side of the rail member;

a second bracket displaceable relative to the first bracket;

a locking member arranged on one of the first bracket and the rail member and movable relative to the first bracket between a locking state and an unlocking state;

a working feature arranged on the second bracket;

a first mounting member arranged on the first bracket and configured to be mounted on the first post of the rack;

a second mounting member arranged on the second bracket and configured to be mounted on the second post of the rack;

wherein when the first bracket is located at a predetermined position relative to the second bracket, the locking member in the locking state is configured to engage with the working feature to maintain the first mounting member and the second mounting member being mounted on the first post and the second post of the rack, respectively, thereby preventing detachment of the supporting assembly from the rack.

12. The supporting assembly of claim 11, further comprising a resilient member configured to provide a resilient force to one of the first bracket and the second bracket.

13. The supporting assembly of claim 12, wherein one of the first bracket and the second bracket comprises a channel for movably mounting another one of the first bracket and the second bracket.

14. The supporting assembly of claim 11, further comprising an operating member configured to operate the locking member from the locking state to the unlocking state for disengaging the locking member from the working feature, thereby allowing the first bracket to move away from the predetermined position relative to the second bracket by a relative displacement of the first bracket and the second bracket.

15. The supporting assembly of claim 14, further comprising a recovering resilient member configured to provide a recovering resilient force to the operating member.

16. The supporting assembly of claim 11, wherein each of the first bracket and the second bracket comprises a longitudinal wall and an end plate perpendicularly bent from the longitudinal wall, the first mounting member is arranged on the end plate of the first bracket, and the second mounting member is arranged on the end plate of the second bracket.

17. A method of mounting a supporting assembly on a rack, the method comprising:

providing a first bracket and a second bracket, and arranging a plurality of working features on the second bracket;

providing a locking member, and configuring the locking member in a locking state to engage with one of the plurality of working features to prevent the first bracket and the second bracket from displacing relative to each other;

providing an operating member for operating the locking member;

operating the operating member from a first position to a second position to drive the locking member from the locking state to an unlocking state for preventing the locking member from engaging with any of the plurality of working features, thereby allowing the first bracket and the second bracket to displace relative to each other;

mounting the first bracket and the second bracket on a first post and a second post of the rack, respectively, with a resilient force provided by a resilient member and applied on one of the first bracket and the second bracket, so that the first bracket is located at a predetermined position relative to the second bracket; and releasing the operating member, so that the operating member moves from the second position to the first position to drive the locking member from the unlocking state to the locking state for engaging the locking member with a corresponding one of the plurality of working features, thereby preventing detachment of the first bracket from the first post of the rack and detachment of the second bracket from the second post of the rack.

18. The method of claim 17, further comprising:

operating the operating member from the first position to the second position again to drive the locking member from the locking state to the unlocking state for allowing the first bracket and the second bracket to displace relative to each other, thereby allowing the detachment of the first bracket from the first post of the rack and the detachment of the second bracket from the second post of the rack.

* * * * *